United States Patent [19]

Irvine et al.

[11] Patent Number: 4,728,095

[45] Date of Patent: Mar. 1, 1988

[54] SEPARATOR FOR A DOCUMENT FEEDER

[75] Inventors: Robert Irvine, Riverside; Harry E. Luperti, Wilton, both of Conn.

[73] Assignee: Pitney Bowes Inc., Stamford, Conn.

[21] Appl. No.: 850,423

[22] Filed: Apr. 7, 1986

Related U.S. Application Data

[63] Continuation of Ser. No. 506,155, Jun. 20, 1983, abandoned.

[51] Int. Cl.[4] ..... B65H 3/52

[52] U.S. Cl. ..... 271/124; 271/125; 271/9

[58] Field of Search ..... 271/121, 122, 124, 125, 271/34, 35, 9

[56] References Cited

U.S. PATENT DOCUMENTS

| | | | |
|---|---|---|---|
| 2,359,856 | 10/1944 | Morse | 271/125 |
| 2,705,636 | 4/1955 | La Bombard | 271/124 |
| 2,922,643 | 1/1960 | Lopez | 271/125 |
| 3,047,290 | 7/1962 | Thomsen | 271/125 |
| 3,175,821 | 3/1965 | Gibson | 271/9 |
| 3,966,191 | 6/1976 | Strobel | 271/125 |
| 4,288,068 | 9/1981 | Hashimoto et al. | 271/125 |
| 4,316,606 | 2/1982 | Buys et al. | 271/125 |

FOREIGN PATENT DOCUMENTS

| | | |
|---|---|---|
| 1183877 | 3/1970 | United Kingdom . |
| 1424586 | 2/1976 | United Kingdom . |

OTHER PUBLICATIONS

IBM Tech. Disclosure Bulletin, Sokol, Weat Computation and Roll Gap Generator, Sep. 1975, vol. 18, No. 4.

*Primary Examiner*—H. Grant Skaggs

*Attorney, Agent, or Firm*—Michael J. DeSha; David E. Pitchenik; Melvin J. Scolnick

[57] ABSTRACT

An improved separator assembly for document feeders comprises a retarding roller and a cooperating opposed feed roller. The retarding roller is selectably rotatable into orientations such that the selected one of a plurality of different peripheral portions of the retarding roller will be oriented into operative position with respect to the feed roller. The retarding roller includes at least one cylindrical portion and another portion which has an interfering member projecting outwardly from the roller. Other surfaces of the retarding roller may comprise different materials in order to avoid scratches on the documents to be fed or to change the frictional force on the documents.

8 Claims, 7 Drawing Figures

SEPARATOR FOR A DOCUMENT FEEDER this application is a continuation of application Ser. No. 506,155, filed June 20, 1983, now abandoned.

The irvention relates to an improved separator assembly fcr document feeders and particularly to separator assemblies for document feeders used at feeding stations in a multiple-station document inserting machine.

Because of the disparate nature of documents to be inserted, in the past, at least two completely different types of separator assemblies have been required to separate and feed batches of documents.

For feeding uniform documents in ranges from relatively thin to medium thicknesses, the separator assembly must be a gap-type separator. In a gap-type separator, the documents feed through the bite between a cylindrical separator stone, typically of carborundum, and an opposing cooperating cylindrical feed roller, typically of urethane. The cylindrical surfaces of the stone and feed roller establish a positive gap at the bite. The term "positive gap" as used herein means that there is nothing which protrudes into the aperture between the stone and feed roller as viewed from the direction of documents to be fed.

Whenever non-uniform materials, such as envelopes, or whenever thicker documents are required to be fed, the gap-type separator assembly is no longer usable. A much more forgiving arrangement is required since the positive gap which is so necessary for feeding the thinner documents exhibits a much greater tendency to jam or feed doubles when it encounters these other materials. If one attempts to feed multiple page documents through the gap-type separator, it tends to peel the pages.

The solution to this problem has historically required a completely separate document feeder which incorporates an interference type separator assembly. In the known interference type separator assemblies, the periphery of the feed roller has a plurality of annular grooves. The cylindrical separator stone of the gap-type separator is replaced by a plurality of inclined raised members which are disposed to protrude respectively into one of the corresponding grooves of the feed roller. The aperture therefore has a toothed or undulating structure. The term interference separator, as used herein, will thus refer to one having an aperture into which a member protrudes to form an interfering structure as viewed from the direction of the documents to be fed.

In order to decrease the friction between the documents and the stone or the raised members or to protect the surface of the documents, typically in both devices a slidable metal sheet has been arranged to selectably cover any desired portion of the stone or the raised members. The adjustment of coverage is normally made on a trial and error basis during sample runs. The adjustment point on known feeders is relatively inaccessible because of the location of the separator assembly within the feeder.

While these devices are used satisfactorily when the documents to be fed are relatively unchanging from one run to the next, significant down time has been required for removing one feeder and installing and adjusting a new feeder in order to change from one type of document to another.

It has now been discovered that, as disclosed herein, a single separator assembly can include these formerly incompatible separator functions and in such manner that the desired feeding characteristics are easily selected from outside the document feeder. The time required for changing from feeding one type of document to another is thus substantially minimized and the operator convenience significantly enhanced.

In accordance with the invention, the separator device comprises a novel retarding roller and a cooperating opposed feed roller. The retarding roller is selectably rotatable such that one of a plurality of different peripheral portions of the retarding roller will be oriented toward the feed roller. The retarding roller includes at least one cylindrical peripheral portion and at least one other peripheral portion which has at least one, preferably arcuate, interfering member projecting outward from substantially flat shoulders notched into the retarding roller at either side of the member. For best results the retarding roller includes at least 4 different peripheral portions, one of each of the two previously described types having a surface of carborundum, for instance, and the other two having a surface suitably of urethane or simiar material selectable as necessary, to avoid scratches on the surface of, for instance, glassine covers, coated stock, and the like.

The feed roller has an annular groove corresponding to the position of the interfering members of the retarding roller such that when an interfering member on the periphery of the stone is directed toward the feed roller, an interference type separator is established by the projection of the interference member into the groove. When a cylindrical face of the retarding roller is directed toward the feed roller, a gap type separator is established between the retarding roller and the periphery of the feed roller. The retarding roller is rotatable, for example, by an external knob and may be held fixed in the selected position by suitable locking means.

Preferably, the vertical dimension of the bite between the retarding roller and the feed roller is adjustable. The retarding roller may be made to rotate on an eccentric axis to accomplish this adjustment; however, for best results, the feed roller is mounted on a frame moveable with respect to the retarding roller so that the vertical opening of the bite may be made narrower or wider as required for the selected documents to be fed.

Further features and advantages of the apparatus in accordance with the invention will be clearly seen and more easily understood from the description of the figures wherein.

Figure 1:
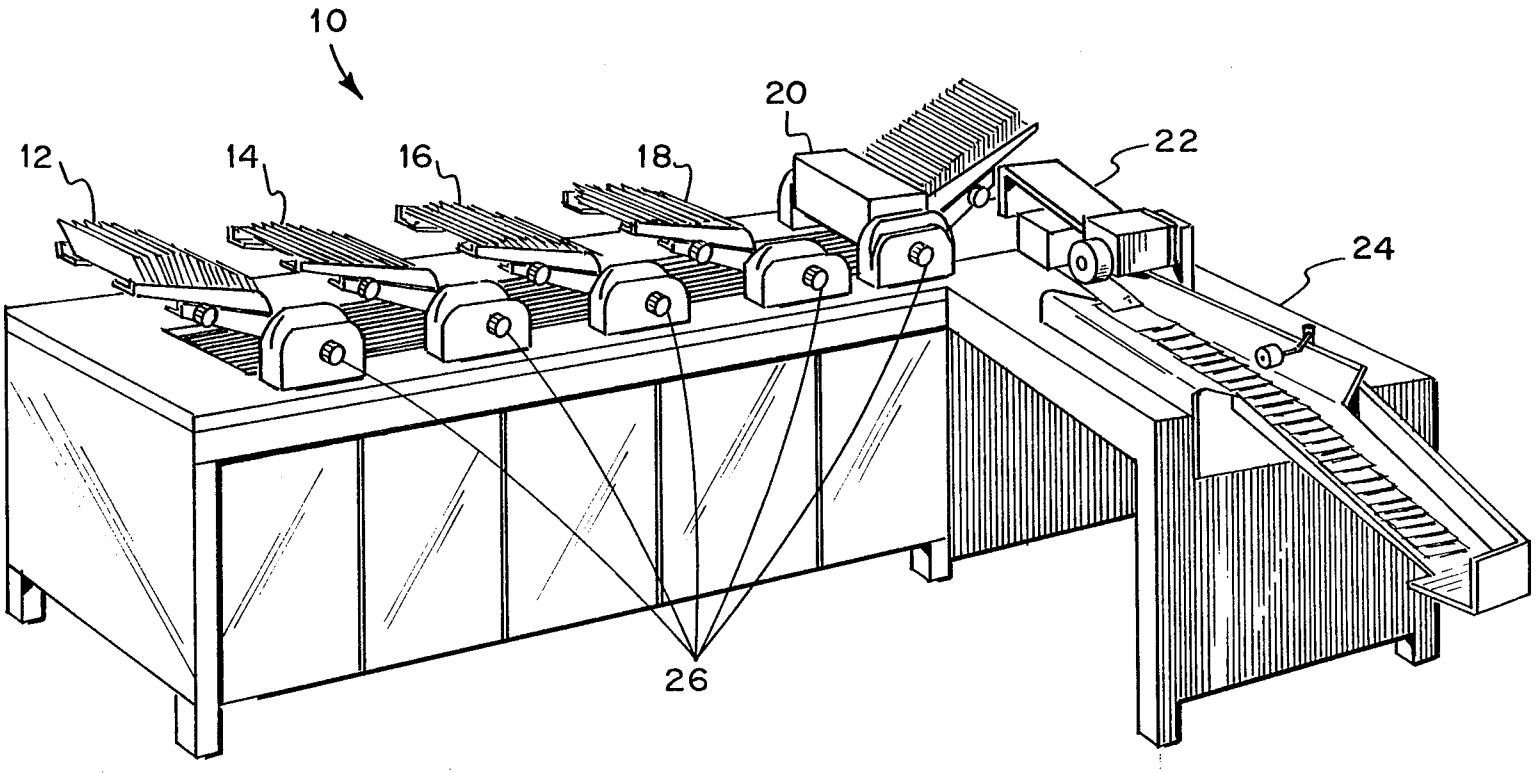
FIG. 1 shows a multiple station document inserting machine in a typical arrangement with a mailing machine and a power stacker.

FIG. 1 illustrates a multiple station document inserting machine 10 having a plurality of feeding stations 12, 14, 16, 18, and 20, the feeders 12, 14, 16, and 18 suitably including separators in accordance with the invention disclosed herein as is indicated, for instance, by the external knob denoted on each by the numeral 26. The inserting machine 10 is combined with a mailing machine 22 and a power stacker 24 of the type well known in the art. The combination is operative to feed documents from the feeders 12, 14, 16, and 18 in a controlled predetermined sequence for insertion into an envelope fed from envelope feeder 20. Typically, the envelopes are sealed, meter stamped at mailing machine 22 and stacked by the power stacker 24.

Figure 2:
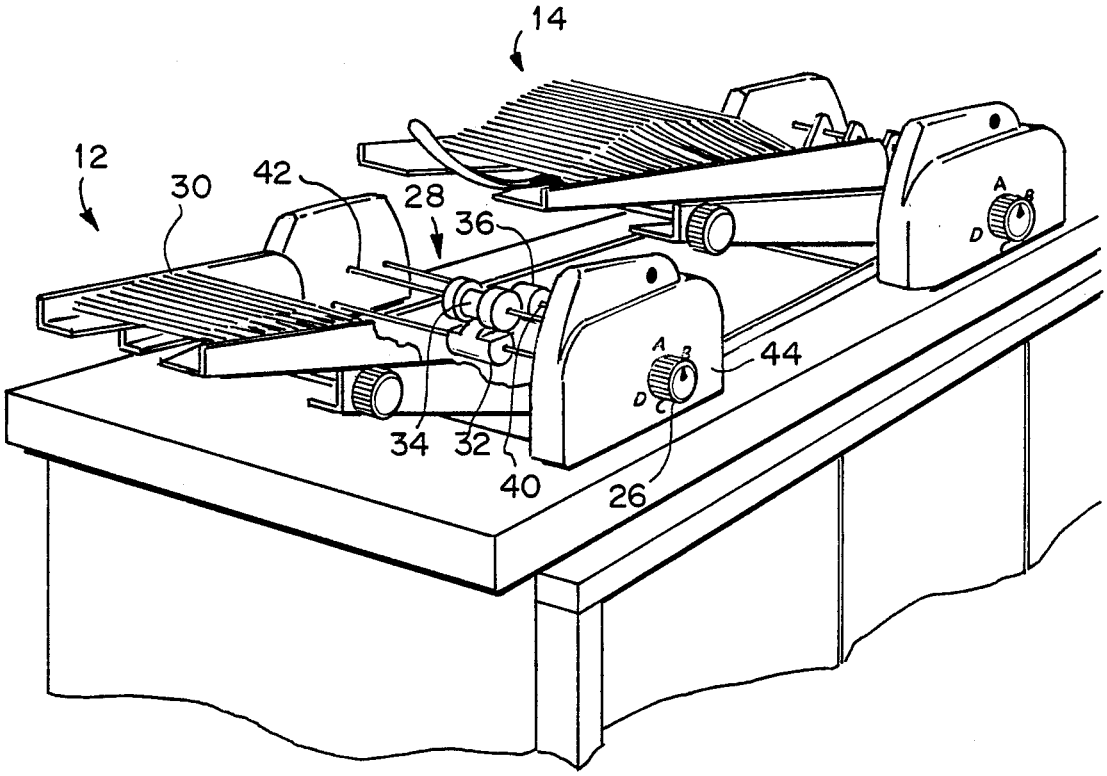
FIG. 2 is a perspective view of a document feeder, the feeder deck being partially broken to show the installation of a separator assembly in accordance with the invention.

Referring now to FIG. 2, a perspective view of the feeders in accordance with the invention is seen with the feed deck of feeder 12 being shown partially broken in order to more clearly illustrate the location and operation of the separator assembly shown generally at 28. Feed deck 30 carries a plurality of documents thereon into abutment against retarding roller 32, described in greater detail below, where they are deflected and fed one at a time through the bite between the feed roller 34 and retarding roller 32 by the cooperating rolling engagement of feed roller 34 against the upper surface of the topmost document. The documents feed in timed sequence from the separator assembly 28 to the bite between demand roller 36 and roller idlers (not shown). The demand roller 36 is mounted for rotation on shaft 40 which is in turn driven via timing belts and pulleys (not shown) for timed rotation with the feed roller 34. The operation of such feeders is well known and will not be further described herein.

In the illustrated embodiment, the retarding roller 32 is rigidly fixed to shaft 42 which is suitably journalled on each side of frame 44 for rotation thereon. Conveniently knob 26 is attached at one end of shaft 42 to provide external means for manually rotating the shaft 42 to orient a selected peripheral portion of retarding roller 32 toward the feed roller 34. It will be appreciated that the shaft 42 alternatively may be rotated by a simple external lever arrangement or that the knob 26 may be utilized to rotate the shaft 42 via gears or other transmission devices well known in the art. It will be further appreciated that the invention is not limited to manual rotation of the retarding roller 32. The retarding roller may be positioned, for example, by a suitable stepper motor, servo-motor, or the like in response to command from a microprocessor.

Figure 3:
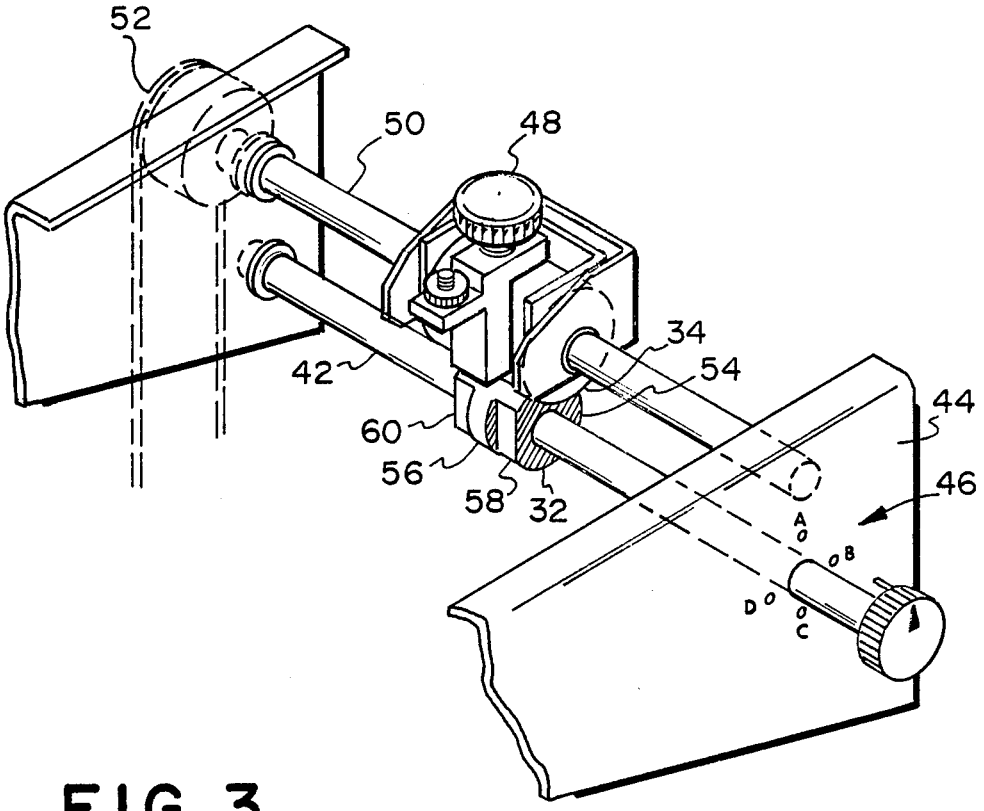
FIG. 3 is a perspective view of a first embodiment of the separator assembly in accordance with the invention wherein other parts of the feeder are not shown for the sake of clarity.

FIG. 3 is a perspective view of the separator assembly 28, the remaining portions of the feeder not being shown in order that the features in accordance with the invention may be seen more clearly.

A locking device indicated generally at 46 holds the retarding roller 32 in the selected orientation. The locking device is conveniently simply a plurality of spaced holes on the frame 44, each defining a particular orientation, for receiving a mating pin on the knob. Other suitable means for locking the shaft, as for instance by providing a ledge on the frame for preventing further movement of a member protruding from the shaft, will occur to one skilled in the art.

An adjusting mechanism shown generally at 48 is provided for adjusting the distance between centers of the feed and retarding rollers to change the vertical dimension of the bite therebetween. The adjusting mechanism may be any well known suitable adjusting means such as, for instance, a threaded rod for engaging a mating threaded hole for moving the feed roller with respect to the retarding roller as the threaded rod is turned.

Feed roller 34 is mounted for rotation upon shaft 50. The shaft 50 is in turn driven by drive chain 52 in timed relationship with the shaft of the demand roller (not shown in FIG. 3).

Figure 4A:
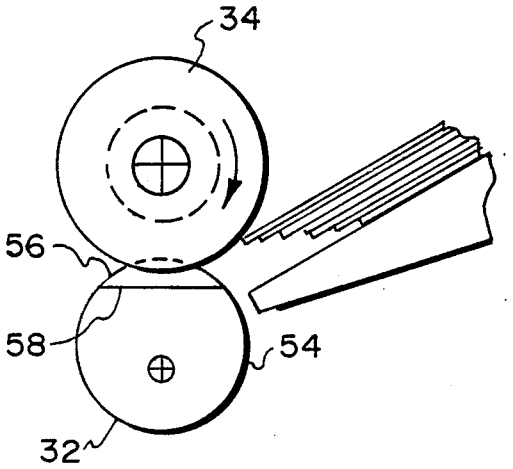
FIGS. 4A and 4B show, respectively, a side view and a rear view of a first embodiment of the feed roller and the retarding roller in accordance with the invention illustrating one orientation of the retarding roller.
Figure 4B:
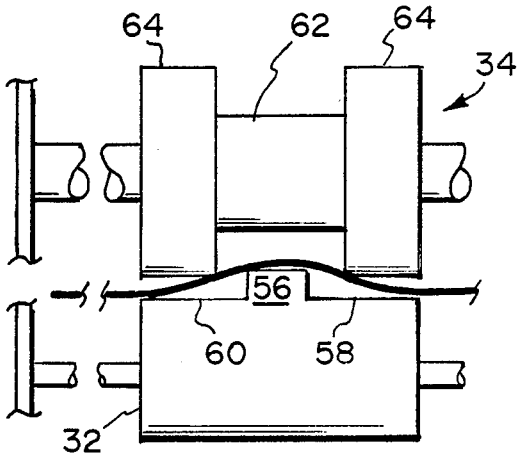

As seen in FIG. 3 and from the side and rear views of the retarding roller in FIGS. 4A and 4B, the retarding roller in accordance with the invention in a first embodiment is a substantially cylindrical member, preferably of carborundum and including a cylindrical peripheral portion 54 and another peripheral portion having an interfering member 56 shown directed radially outwardly from the retarding roller 32. As shown, the interfering member 56 is a substantially arcuate section created by substantially flat adjacent shoulders 58 and 60 notched into the periphery of the cylinder. In the illustrated orientation of FIGS. 4A and 4B, the interfering member 56 projects into the annular groove 62 of the feed roller 34. As best seen in FIG. 4B, the member 56 and the groove 62 constitute the elements of an interference type separator in which the aperture has a toothed appearance. As also seen in FIG. 4B, a document in cross section is in passage through the aperture. It will be appreciated that the vertical dimension of the aperture is not critical in this orientation since the interfering member 56 serves to prevent the passage of underlying documents as the topmost is flexed for feeding through the aperture.

It will be understood that while only one interfering member is illustrated there may, alternatively, be a plurality of such members. The only limitation is that the width of the feed roller be greater than the total width of the interfering members since it has been found necessary for effective feeding of the documents that the wings (sides) of the document be directed downwardly (toward the retarding roller). When the outer ends of the periphery of the feed roller extend beyond the interfering member, there is assurance that the sides of the document are properly directed toward the retarding roller.

It will be appreciated as well that the interfering member may also be attached by any suitable conventional means to a flattened area of the periphery of the retarding roller. It is not necessary that the retarding roller be notched since the interfering member may extend radially outward a greater distance than the radius of curvature of the remainder of the cylinder. It is also apparent that it is only necessary that the surface of the interfering member at the feed site gradually rise into the bite, thus, the remainder of the interfering member following the bite may be truncated or of a different shape if desired.

As can be seen in FIGS. 4A and 4B the retarding roller 32 is mounted eccentrically on its axis. The bite width is thus varied in correspondence with the rotational position to which the retarding roller is rotated.

Figure 5A:
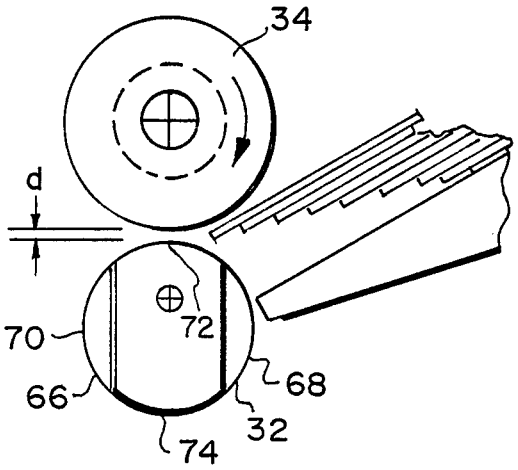
FIGS. 5A and 5B show, respectively, a side view and a rear view of a second embodiment of the invention illustrating a second orientation of the retarding roller.
Figure 5B:
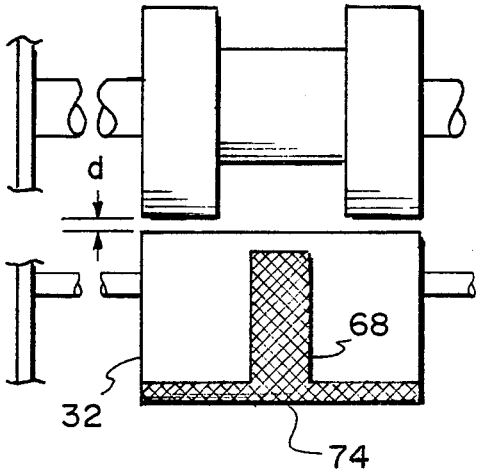

FIGS. 5A and 5B shows a second embodiment of a retarding roller in accordance with the invention oriented so as to form a gap-type separator. It will be understood that the retarding roller illustrated in FIGS. 4A and 4B can be oriented to a similar position and the following discussion will apply to both embodiments. When the retarding roller is oriented by turning the shaft 42 so that a cylindrical portion is directed toward the feed roller 34 then the separator assembly 28 acts as a gap-type separator. The annular groove 62 in this orientation has no effect and a positive gap is established between the periphery 64 of the feed roller and the cylindrical surface (54, 72) of the retarding roller.

In the embodiment of FIG. 5, the retarding roller 66 has a first interfering member 68 as described above on one side of the cylindrical body and a second interfering member 70 of a material of different surface coefficient of friction on the diametrically opposite side. The peripheral surfaces 72 and 74 between the two interfering members are cylindrical. One cylindrical portion 74 is of a different surface coefficent of friction than the diametrically opposite portion 72. The surfaces having a different coefficient of friction may be of urethane, for example, and may be bonded to a body of carborundum or of a different urethane material as desired. It will be appreciated that any suitable materials well known to persons skilled in the art may be substituted as desired. It will also be understood that the number of different surfaces on one retarding roller each having a different coefficient of friction is limited only by the dimensions of the operative surfaces of the roller so that there may alternatively be more than four such surfaces if desired.

For operation, the particular peripheral portion to be utilized is selected by rotation of knob 26 and locked into operative position to achieve the desired interference or gap-type separator. In the case of the embodiment of FIGS. 5A and 5B, a desired surface coefficient of friction is selectable as well by appropriate positioning of the retarding roller. The opening of the bite between the feed roller and the retarding roller is then adjusted by means of the adjusting mechanism 48 to a dimension "d" to appropriately correspond to the thickness of the documents to be fed.

It will be appreciated by a person in the art that there has now been disclosed a novel separator assembly which provides in one feeder both a gap-type and an interference type separator each of which are easily selectable and adjustable by an operator.

It will be further understood that the claims are intended to cover all changes and modifications of the embodiments of the invention, herein chosen for the purpose of illustrations, which do not constitute departures from the scope and spirit of the invention.

What is claimed is:

1. In an apparatus for feeding documents, a separator assembly for separating and feeding individual documents comprising a rotatably mounted feed roller and a spaced, opposed retarding roller defining a bite therebetween, said retarding roller being rotatable between at least first and second positions wherein in one of said positions a positive gap is established at the bite of said retarding roller and said feed roller for forming a gap-type separator and in the other of said positions said retarding roller having an interfering member projecting from said retarding roller into said bite for forming an interference type separator.

2. Apparatus for feeding documents having differing feed requirements comprising:

(a) a feed deck for carrying a plurality of documents; and (b) a separator assembly disposed adjacent said feed deck for receiving documents from said feed deck, said separator assembly including:

(i) a retarding roller disposed adjacent said feed deck for supporting and deflecting documents carried to the separator assembly from the feed deck;

(ii) a feed roller rotatably mounted in opposing spaced relationship to said retarding roller, said feed roller having at least one annular groove about the periphery thereof, said opposing spaced relationship establishing a bite between said feed roller and said retarding roller, said feed roller being operative upon rotation for feeding documents through the bite between itself and said retarding roller;

(iii) said retarding roller having a first peripheral surface portion, said first peripheral surface portion including at least one interfering member extending outwardly from said retarding roller, said interfering member being operative in cooperation with the groove of said feed roller for forming an interference separator and said retarding roller having a second peripheral portion operative in cooperation with a peripheral portion of said feed roller for forming a gap separator;

(iv) means for selectably rotating said retarding roller wherein said first and said second peripheral portions are respectively positionable into the operative cooperating relationship with said feed roller; and (v) drive means for driving said feed roller.

3. The apparatus of cláim 2 wherein said retarding roller is cylindrical and said second peripheral portion is a cylindrical surface portion of said retarding roller and wherein the interference member of said first peripheral portion is formed as a radially outwardly projecting cylindrical portion extending above adjacent shoulders notched into the retarding roller.

4. The apparatus of claim 2 wherein said retarding roller has at least a third peripheral portion having a different surface coefficient of friction from said first and second peripheral portions, said third peripheral portion being rotatable into cooperating opposed relationship with said feed roller.

5. The apparatus of claim 2 wherein said means for selectably rotating comprises a shaft and means for rotating said shaft, said retarding roller being rigidly affixed to said shaft.

6. A separator assembly for a document feeder comprising:

(a) a frame member having a rotatable shaft journalled thereon;

(b) a cylindrical retarding roller rigidly affixed to said rotatable shaft for rotation therewith;

(c) a cylindrical feed roller rotatably mounted on said frame member, said feed roller having an annular groove, said feed roller being mounted in spaced opposing relationship to said retard roller and defining a bite therebetween;

(d) means for rotating said feed roller, the rotation of said feed roller being operative for feeding documents through the bite between the feed roller and the retarding roller;

(e) said retarding roller having a first peripheral surface portion, said first peripheral surface portion including at least one interfering member extending outwardly from said retarding roller, said interfering member being operative in cooperation with the groove of said feed roller for forming an interference separator and said retarding roller having a second peripheral portion operative in cooperation with a peripheral portion of said feed roller for forming a gap separator;

(f) means for selectably rotating said retarding roller wherein said first and said second peripheral portions are respectively positionable into the operative cooperating relationship with said feed roller; and (g) drive means for driving said feed roller.

7. The apparatus of claim 6 wherein said retarding roller has at least a third peripheral portion having a different surface coefficient of friction from said first and second peripheral portions, said third peripheral portion being rotatable into cooperating opposed relationship with said feed roller.

8. The apparatus of claim 6 wherein said retarding roller is eccentrically mounted on a shaft wherein said means for selectably rotating also serves to select the width of the bite in accordance with the rotational position of the retarding roller.

* * * * *